US011607819B2

(12) United States Patent
Seferi et al.

(10) Patent No.: US 11,607,819 B2
(45) Date of Patent: Mar. 21, 2023

(54) ANTI-CLOGGING RAZOR

(71) Applicants: Erin K. Seferi, Southbury, CT (US); Nicholas L. Seferi, Southbury, CT (US)

(72) Inventors: Erin K. Seferi, Southbury, CT (US); Nicholas L. Seferi, Southbury, CT (US)

( * ) Notice: Subject to any disclaimer, the term of this patent is extended or adjusted under 35 U.S.C. 154(b) by 0 days.

(21) Appl. No.: 17/883,536

(22) Filed: Aug. 8, 2022

(65) Prior Publication Data

US 2022/0379508 A1 Dec. 1, 2022

Related U.S. Application Data

(63) Continuation-in-part of application No. 17/185,951, filed on Feb. 25, 2021.

(51) Int. Cl.
*B26B 21/44* (2006.01)

(52) U.S. Cl.
CPC ..... *B26B 21/44* (2013.01)

(58) Field of Classification Search
CPC ..... B26B 21/44; B26B 21/36; B26B 21/565; B26B 3/04; B26B 21/52
See application file for complete search history.

(56) References Cited

U.S. PATENT DOCUMENTS 1,444,764 A 2/1923 Rohde
3,238,617 A * 3/1966 Larson ..... B26B 21/36 30/44
3,802,072 A * 4/1974 Wintercorn ..... B26B 21/34 30/81
4,378,633 A * 4/1983 Jacobson ..... B26B 21/227 30/47
6,615,498 B1 * 9/2003 King ..... B26B 21/521 30/527
2011/0146079 A1 * 6/2011 Clarke ..... B26B 21/4012 30/34.05
2012/0317818 A1 * 12/2012 Oglesby ..... B26B 21/4018 30/77

FOREIGN PATENT DOCUMENTS

WO WO-9525617 A1 * 9/1995 ..... B26B 21/22
WO WO-9625276 A1 8/1996
WO WO-2007116397 A2 * 10/2007 ..... B26B 21/12

* cited by examiner

*Primary Examiner* — Evan H MacFarlane
*Assistant Examiner* — Liang Dong
(74) *Attorney, Agent, or Firm* — Robert J. Hess; Hess Patent Law Firm

(57) ABSTRACT

Anti-clogging manual razor cartridge equipped with an arrangement of rollers and cutting blades arranged in an alternating manner with each other, namely, a leading roller, a leading cutting blade, a trailing roller, a trailing cutting blade and a final cutting blade. Each of the cutting blades are bent to obliquely angle two portions thereof with one of the two portions terminating into a sharpened edge. The arrangement is such that the sharpened edge of the leading cutting blade is over the leading roller, the sharpened edge of the trailing cutting blade is over the trailing roller, the sharpened edge of the final cutting blade is over the trailing cutting blade.

11 Claims, 10 Drawing Sheets

ANTI-CLOGGING RAZOR

CROSS-REFERENCE TO RELATED APPLICATIONS

This is a continuation-in-part of patent application Ser. No. 17/185,951 filed Feb. 25, 2021.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of the Invention

The invention relates to a handheld razor equipped with razor cartridge that provides features that help prevent clogging of space between the cutting blades.

2. Description of Information Known to the Inventor, Including References to Specific Documents Related to the Invention, and Specific Problems Involved in the State of Technology that the Invention is Drawn Toward Conventional razor blades inherently clog. The function of cutting hair and moving the hair, skin, and saving cream from one side of the razor to the other creates clogging in the blades. This clogging results in hair being cut multiple times and additional force needed to cut similar amounts of hair. It doesn't matter how many blades are on the razor, clogging will happen. Once the razor is done being used any residual hair, skin, and cream will dry on the blades and will hold moisture on the blades and accelerate dulling.

It is desired to design a razor having features that help prevent clogging of space between cutting blades by residual cut facial hair, facial skin and cream.

SUMMARY OF THE INVENTION

The present inventor has found that by arranging a pair of cutting blades and a pair of rollers in an alternating manner with respect to each other, the rollers move the cut facial hair, cut skin, and cream away from the blades during the shaving process. An additional trailing cutting blade cuts residual facial hair that might have passed the pair of cutting blades uncut.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE DRAWING

Figure 1:
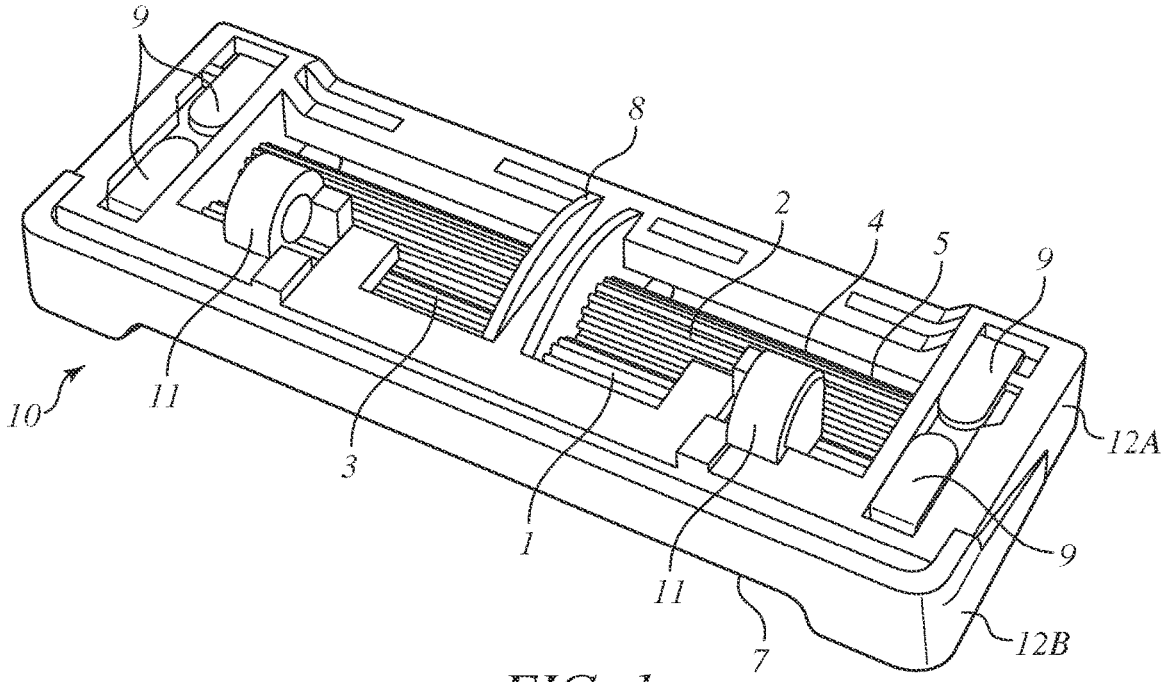
FIG. 1 is an isometric view of the bottom, front and right side of a razor cartridge in accordance with our invention

Turning to the drawings of FIGS. 1-4B and 16, a razor head or razor cartridge 10 has components that include two housing parts 12A, 12B, two rollers 1, 2, three cutting blades 3, 4, 5, one moisturizing strip piece 6 and two staples 9. The two rollers are a leading roller 1 and a trailing roller 2. The cutting blades include a leading cutting blade 3, which is situated between the two rollers, a trailing cutting blade 4 and final cutting blade 5. The trailing cutting blade 4 is situated between the trailing roller 2 and the final cutting blade 5.

Figure 4A:
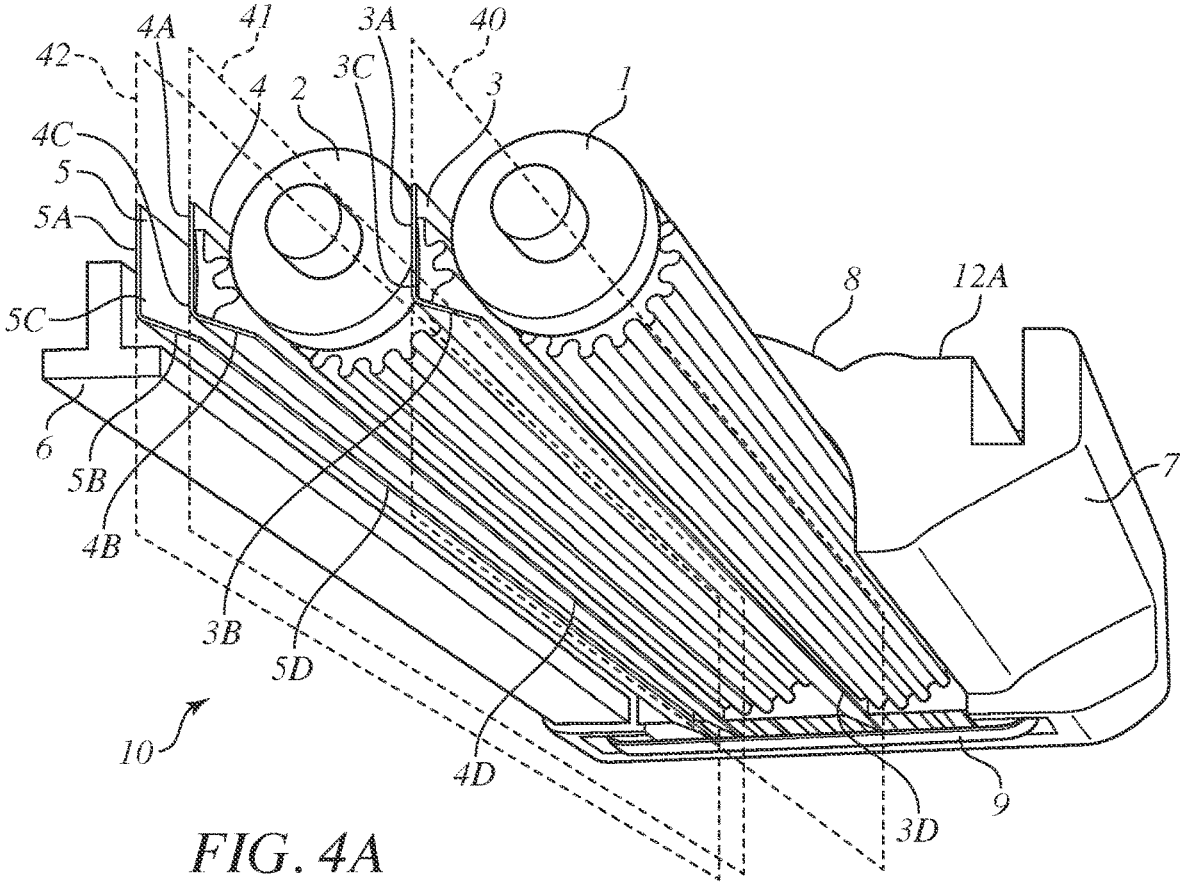
FIGS. 4A and 4B are partially broken isometric views of the top, front and right side of the razor cartridge of FIGS. 1-3, but with the housing frame partially removed to reveal more of the components within the razor cartridge that is visible in FIGS. 1-3.
Figure 4B:
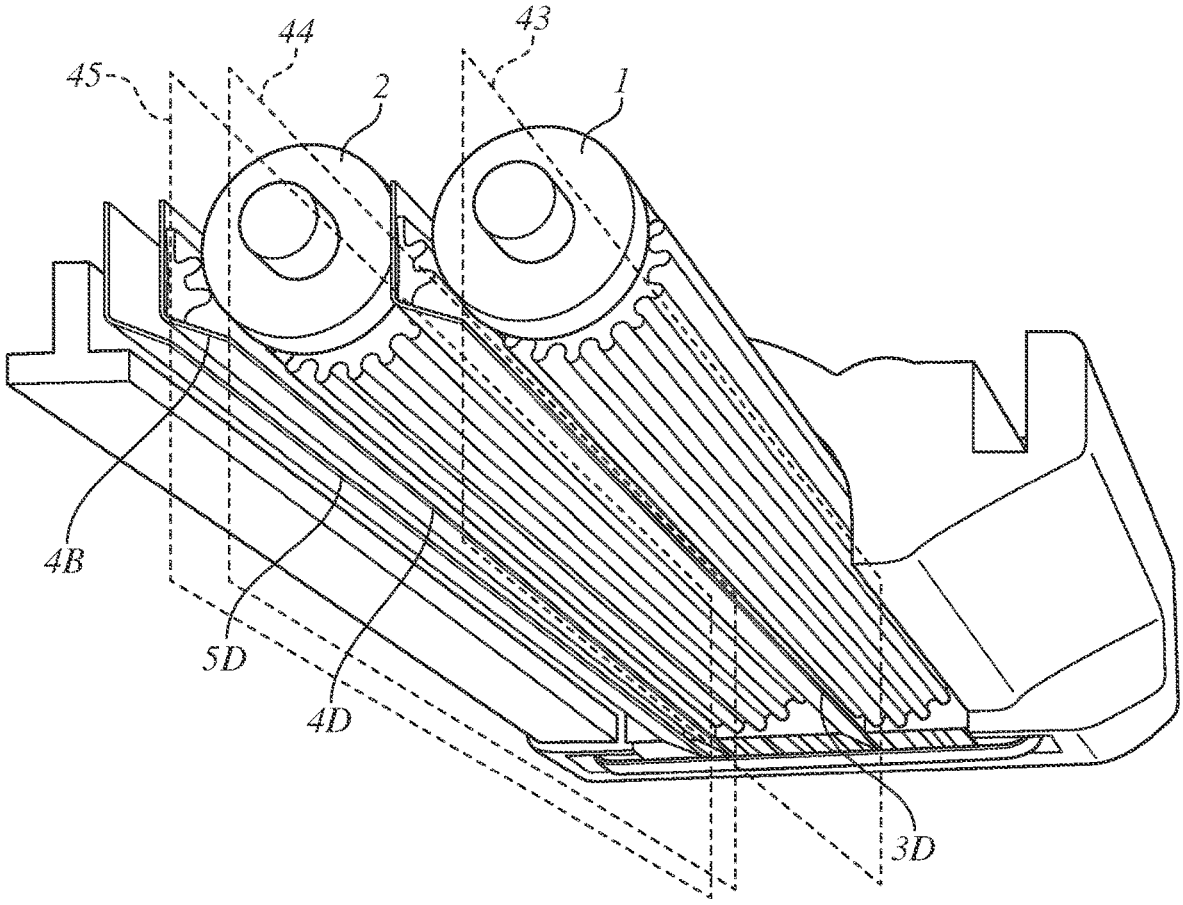

Turning to FIG. 4A, the three cutting blades 3, 4, 5 are each of the same configuration and bent to give rise to an acute angulation between respective base portions 3C, 4C, 5C and inclined portions 3B, 4B, 5B. The inclined portions 3B, 4B, 5B terminate at respective sharpened edges 3D, 4D, 5D that extend lengthwise across the razor cartridge 10 and each of the respective sharpened edges 3D, 4D, 5D are within confines of a common shaving plane. The base portions 3C, 4C, 5C have surfaces that are parallel with each other by extending within respective planes 40, 41, 42 that are each perpendicular to an orientation of the common shaving plane. As best seen in FIG. 4B, the sharpened edges 3D, 4D, 5D are positioned so that respective planes 43, 44, 45 that pass through them are parallel to the respective planes 40, 41, 42 that pass respectively through roller 1, roller 2 and the inclined portion 4B of the cutting blade 4.

The two rollers 1, 2 may be paddle rollers and each has the same configuration, Their exterior surfaces are textured with lengthwise ridges separated from each other circumferentially in succession by associated grooves. Their respective axes of rotation are parallel to each other.

Figure 5:
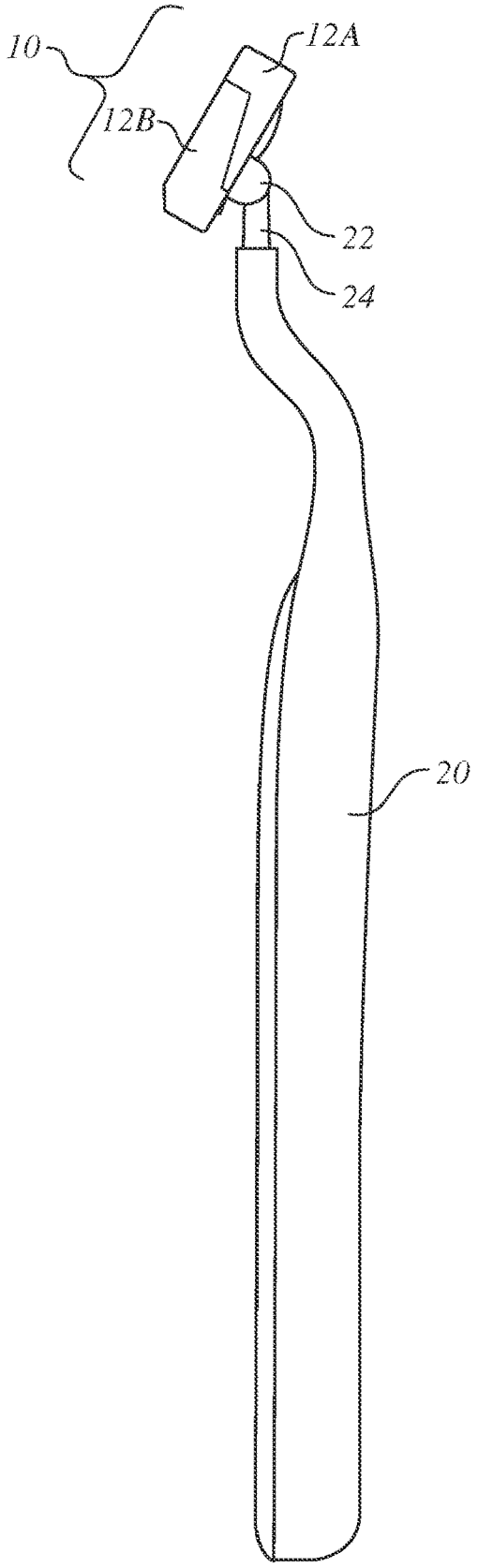
FIG. 5 is a left side elevational view of the razor cartridge of FIGS. 1-4 held by a handle in an upright, vertical orientation suited for carrying out shaving to cut facial hair.
Figure 6:
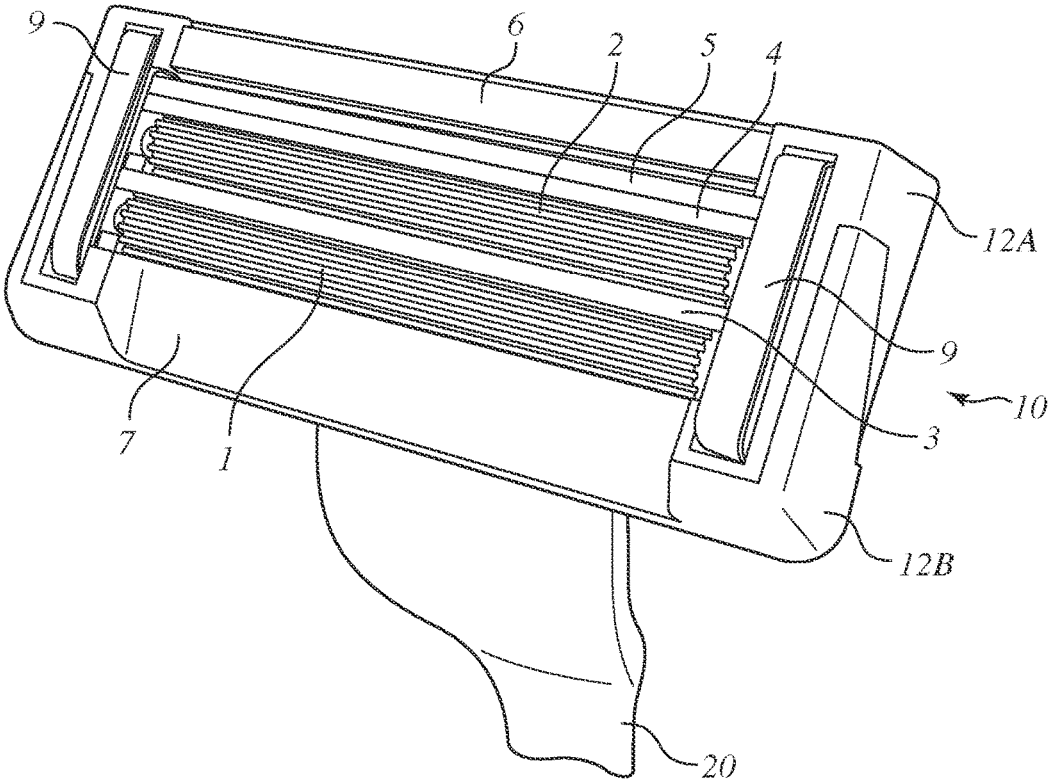
FIG. 6 is an isometric view of the top, front and right side of the razor cartridge and a partially broken view of the front and right side of the handle.
Figure 7:
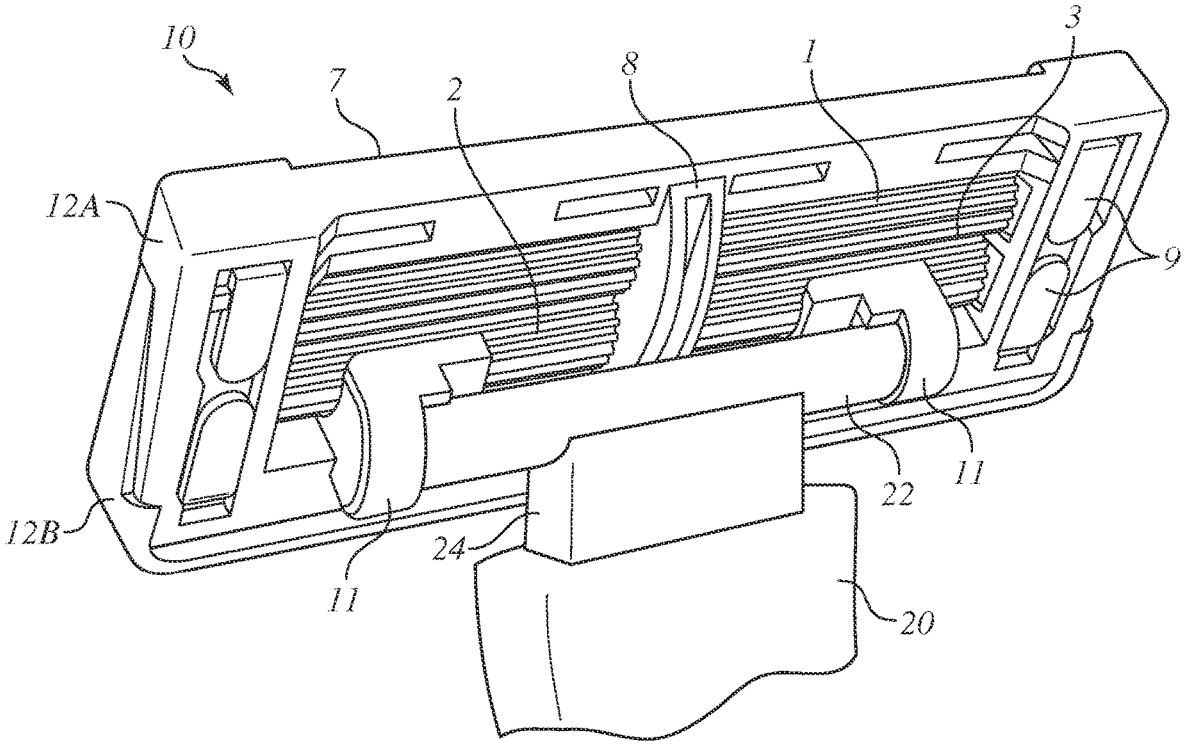
FIG. 7 is an isometric view of the bottom, rear and right side of the razor cartridge and the handle.
Figure 8:
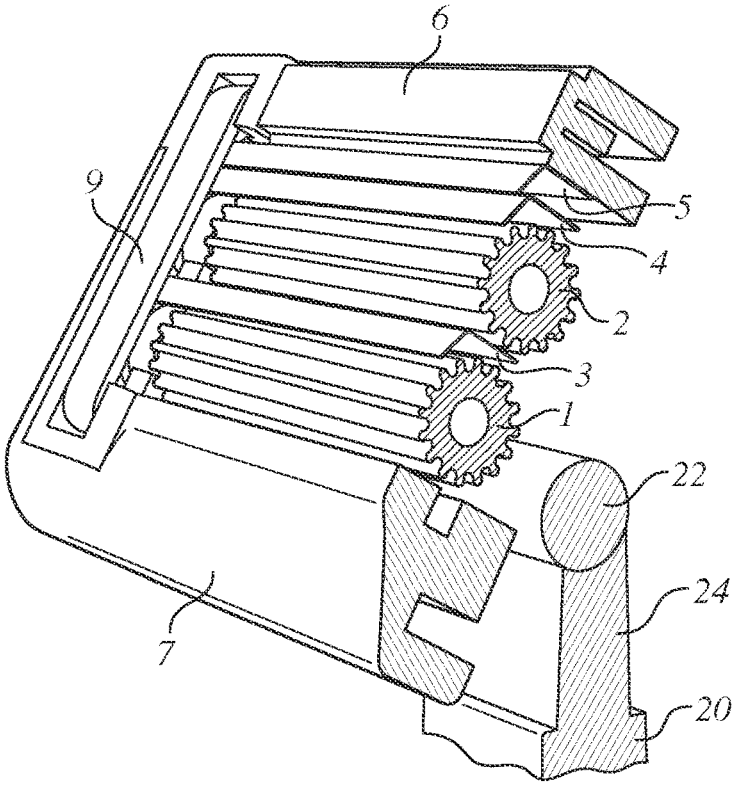
FIG. 8 is an isometric view of the top and front and in cross-section the right side of half of the razor cartridge and handle.
Figure 9:
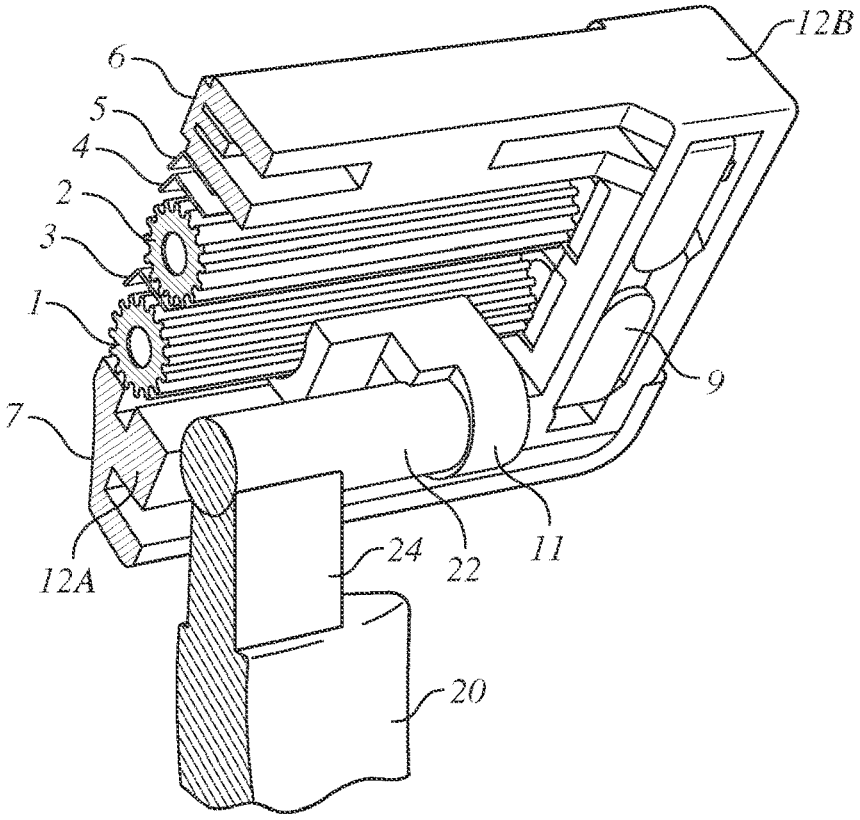
FIG. 9 is an isometric view of the bottom and rear and in cross-section the right side of half of the razor cartridge and handle.

Turning to FIG. 5, with the handle 20 positioned in an upright, vertical orientation, the razor cartridge 10 in an operative cutting position to cut facial hair as the razor cartridge is moved along the face with the facial hair, the relative position of the components with respect to each other and the acute angulation of the bends in the cutting blades 3, 4, 5 causes the inclined portion 3B to extend over the lead roller 1, the inclined portion 4B to extend over the trailing roller 2 and the inclined portion 5B to extend over the trailing cutting blade 4.

Turning to FIGS. 6-9, the components are held in position between two ends of a frame housing 12, which has two parts 12A, 12B, by bent staples 9. A centrally located alignment guide 8 arches over the rollers to help retain the rollers to prevent them from leaving their relative position in the razor cartridge 10 during their respective rotations.

There is a pivotal attachment that is secured to the frame housing 12 and configured to pivotally attach to the handle 20. The pivotal attachment includes two projections 11 spaced apart from each other and each having a respective recess facing opposite each other, a rod 22 retained by both of the respective recesses in a manner that enables the rod 22 to rotate relative to the respective recesses, and a connector 24 situated between the rod 22 and the handle 20 and securing both to each other.

Figure 10:
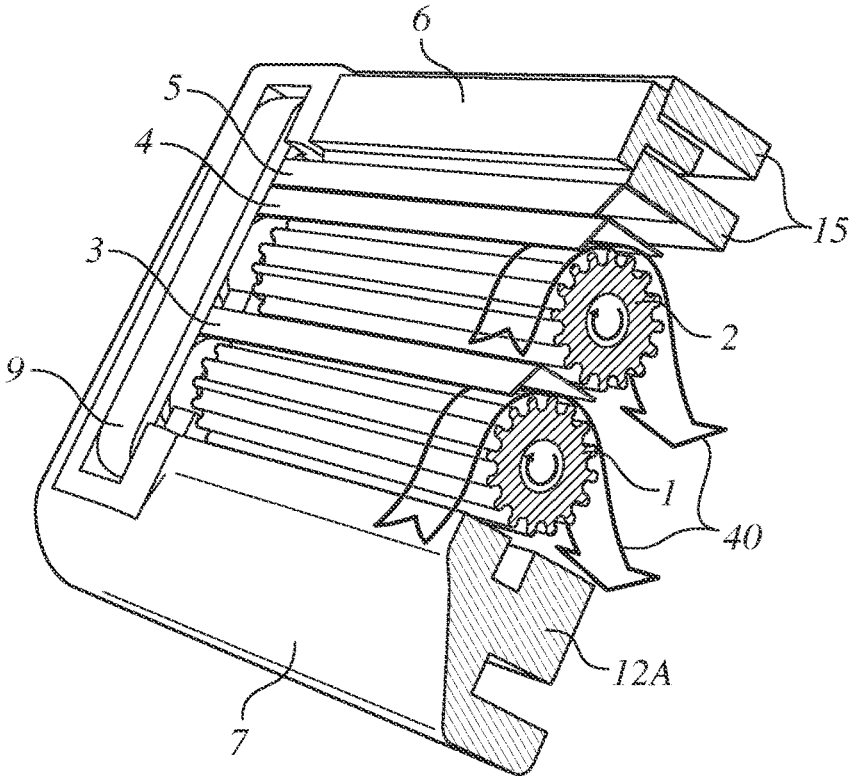
FIG. 10 is an isometric view of half of the razor cartridge that depicts the top and front views and, in cross-section, the right side and that depicts schematic arrows that are indicative of paths followed by cut facial hair.
Figure 11:
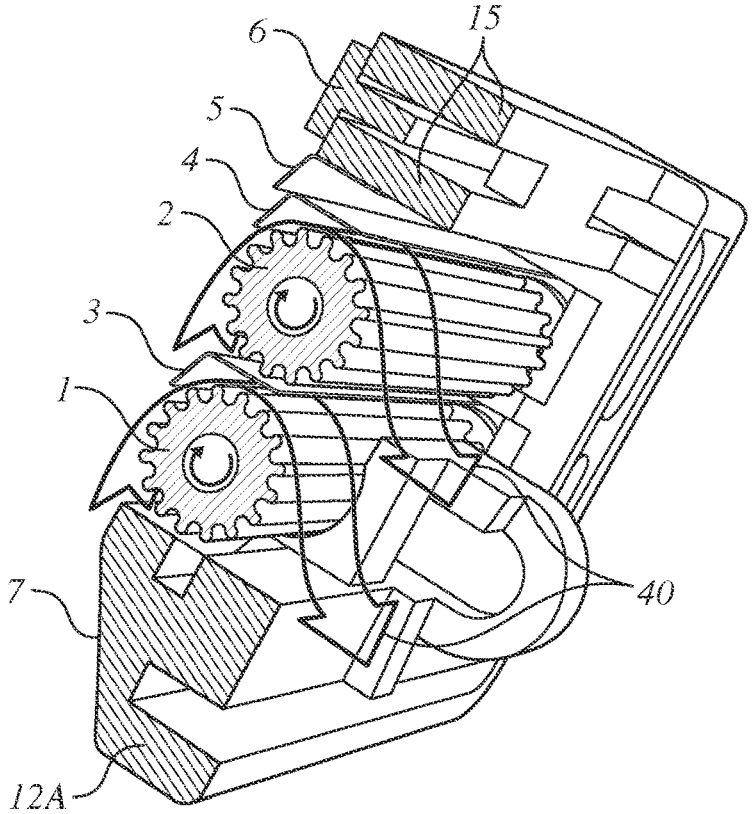
FIG. 11 is an isometric view of half of the razor cartridge that depicts the bottom and rear views and, in cross-section, the right side view and that depicts of schematic arrows that are indicative of paths followed by cut facial hair.

Turning to FIGS. 10 and 11, the rollers 1, 2 are positioned to rotate and their ridges and grooves move cut hair 32 in the direction of the rotation so that the cut hair 32 travels along paths 40. As a result, there is no clogging of the razor cartridge 10 by cut hair 32 in the vicinity of the sharpened edges 3D, 4D where the cutting occurred and the amount of cut hair by the sharpened edge 5D is relatively little that no clogging will occur at that vicinity.

Figure 14:
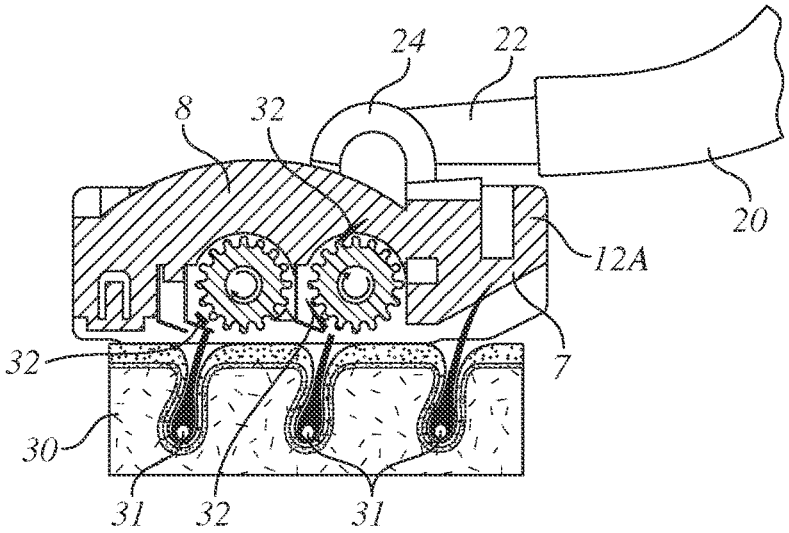
FIGS. 12-14 are progressive schematic views illustrating the movement of the razor along the face to cut facial hair and showing the cut pieces of the facial hair traveling through the razor cartridge.
Figure 13:
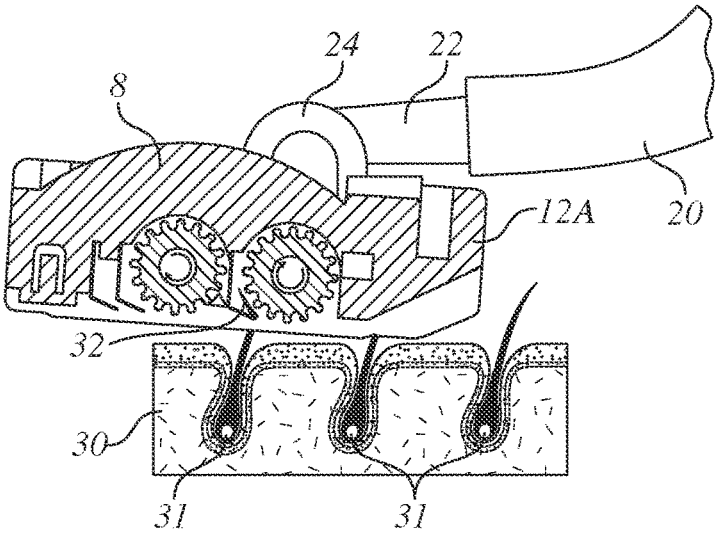
Figure 12:
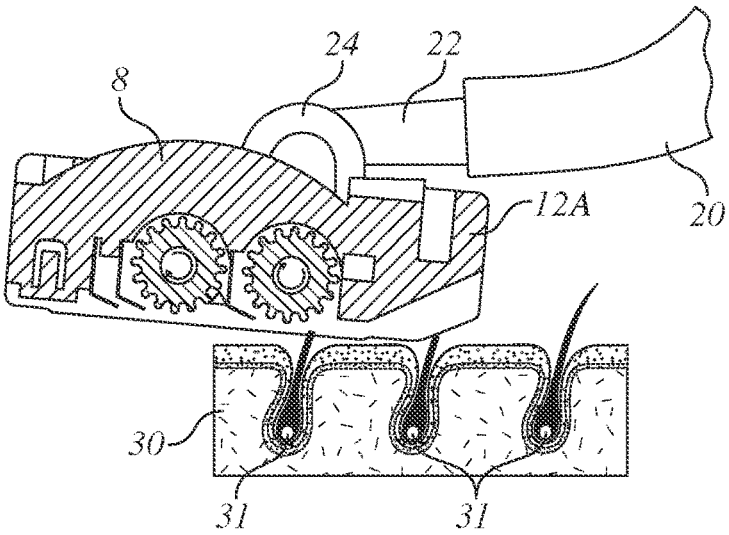

Turning to FIGS. 12-14, the lead roller 1 in front of the lead cutting blade 3 performs the function of moving the initial debris to the back of the razor and clearing a path for more material. (hair, skin, shaving cream). The debris may be cut hair 32, cut skin and shaving cream or lather.

The lead cutting blade 3 performs the function of doing the rough cut, that is, cutting the bulk of the hair as the lead cutter.

The trailing roller 2 is at the same height as the lead roller 1. It has the same ridges and grooves to grip and move hair, skin, and cream away. It is directly in front of the trailing cutting blade 4.

The trailing roller 2 performs the function of clearing the debris from in front of the trailing cutting blade 4 and continuing the cutting and clearing process.

The trailing cutting blade 4 is continuing to cut the hair 31. Now the hair is cut to about skin level.

The final cutting blade 5 is the final cutter. The other two cutting blades (lead blade 3 and trailing cutting blade 4) that perform their cutting functions before that of the final cutting blade 5 have done the majority of the work. The lead roller 1 and trailing roller 2 have cleared the debris away; the final cutting blade 5 performs the finishing cut.

A moisturizing strip 6 that is secured to the frame housing 12B conditions the skin more effectively since there is a cleaner surface.

Water is used to clean the rollers 1, 2. The rollers 1, 2 allow the water discharged under a conventional sink faucet of a residence to rotate them and move material away.

The cutting blades 3, 4, 5 are of conventional materials, preferably metallic such as stainless steel with a sharpened edge at one end. The opposite end of the blade is preferably blunt and thus not sharpened. However, making provision for the bend in the cutting blade to give rise to an oblique angulation of the cutting blade is not conventional.

Thus, the frame housing 12 supports an alternating arrangement of the rollers 1, 2 and cutting blades 3, 4 5, namely, in sequence, the leading roller 1, the leading cutting blade 3, the trailing roller 2, the trailing cutting blade 4 and the final cutting blade 5.

Figure 15:
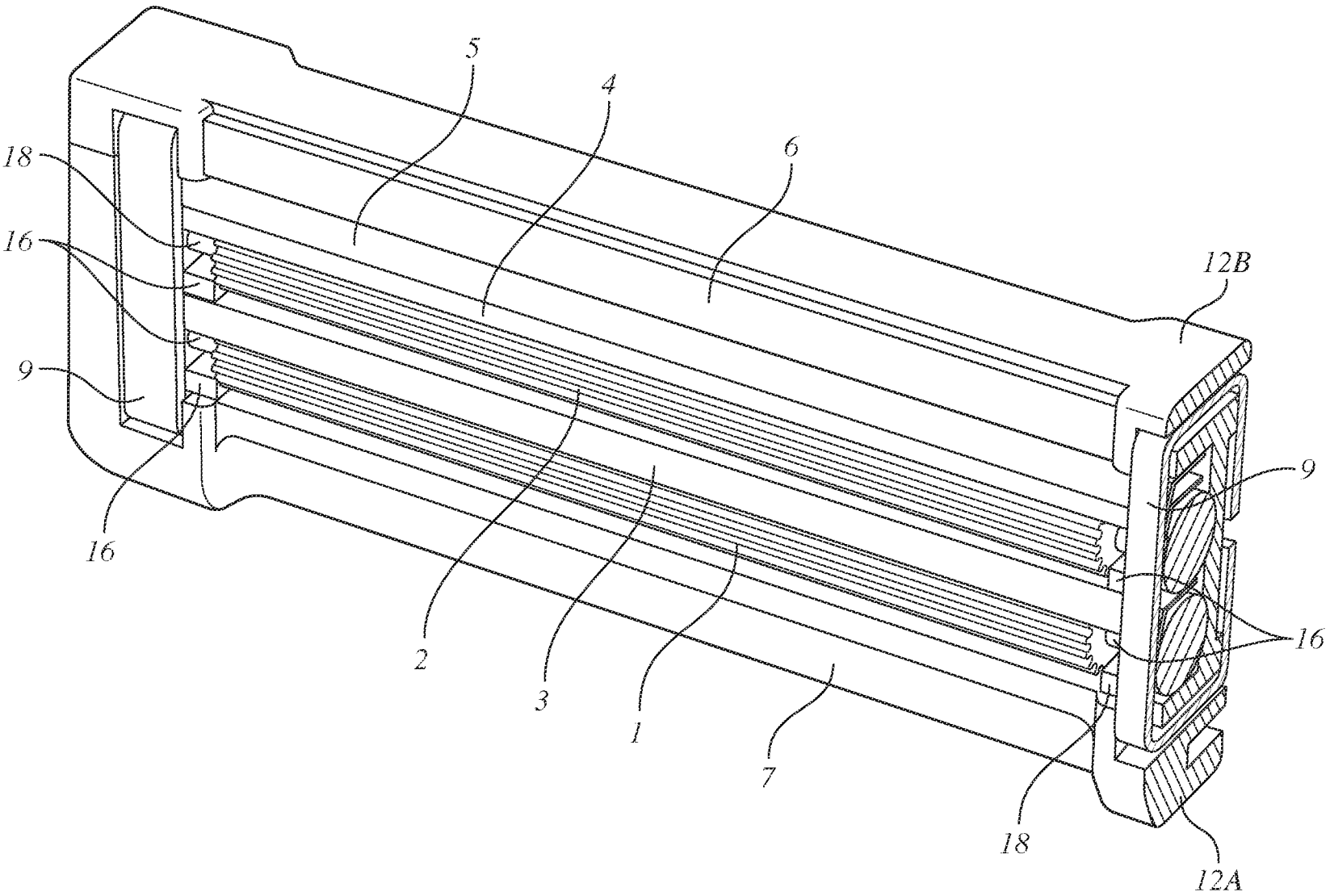
FIG. 15 is a partially broken, isometric view of the top and rear view and of the right side in cross section of the razor cartridge.
Figure 16:
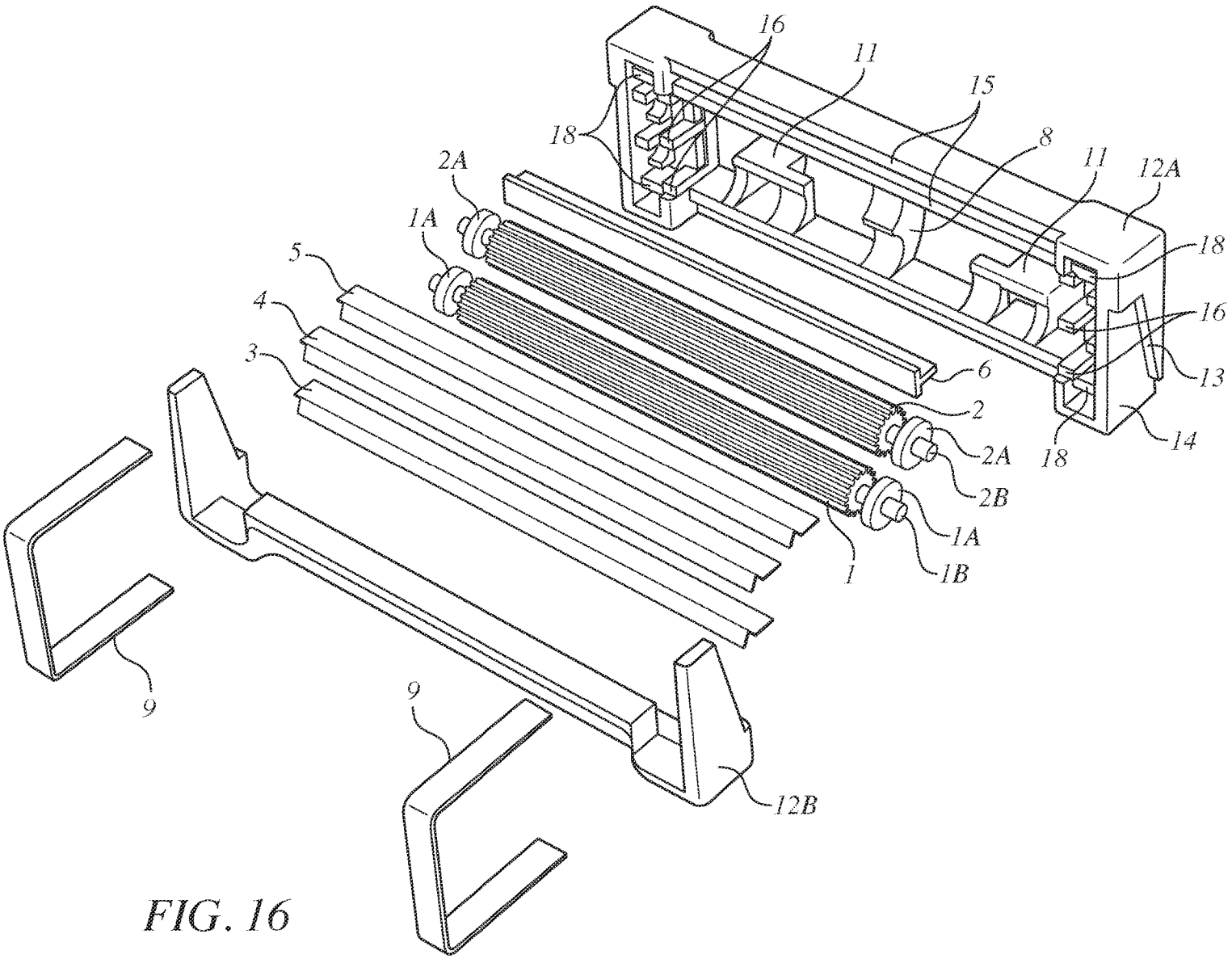
FIG. 16 is an exploded view of the razor cartridge of FIGS. 1-15 prior to assembly.

Turning to FIGS. 15 and 16, the two rollers 1, 2 each has a central portion whose exterior surface is textured with lengthwise ridges separated from each other circumferentially in succession by associated grooves and two end portions. The central portion is between the two end portions. Each end portion has a disc and a shaft. For the leading roller 1, its end portion has a disc 1A and a shaft 1B. The shaft 1B extends outward in opposite directions from a center of the disc 1A.

Likewise, the end portion of the trailing roller 2 has a disc 2A and shaft 2B. The shaft 2B extends outward in opposite directions from a center of the disc 2B. The part 12A of the frame housing 12 has opposite ends each with a recessed configuration defined by a ledge 13 and recessed surface 14. The part 12B of the frame housing 12 has ends shaped to complement the shape of the recessed surface 14 to fit in place.

The moistening strip piece 6 has a T cross-section and its base is fitted between two elongated, parallel risers 15 of the part 12A of the frame housing 12.

The part 12A of the frame housing 12 also has guides 16, 18 to accommodate retaining between them applicable ones of the discs 1B, 2B by supporting the shafts 1A, 1B to allow the shafts 1A, 1B to freely rotate. The staples 9 are each U-shaped and inserted into openings in the part 12A with central their band portions retaining ends of the cutting blades 3, 4, 5 and rollers 1, 2 in place and then their legs are bent into the position shown in FIG. 2. Such can be seen in the cross-section at one end of FIG. 15.

Figure 2:
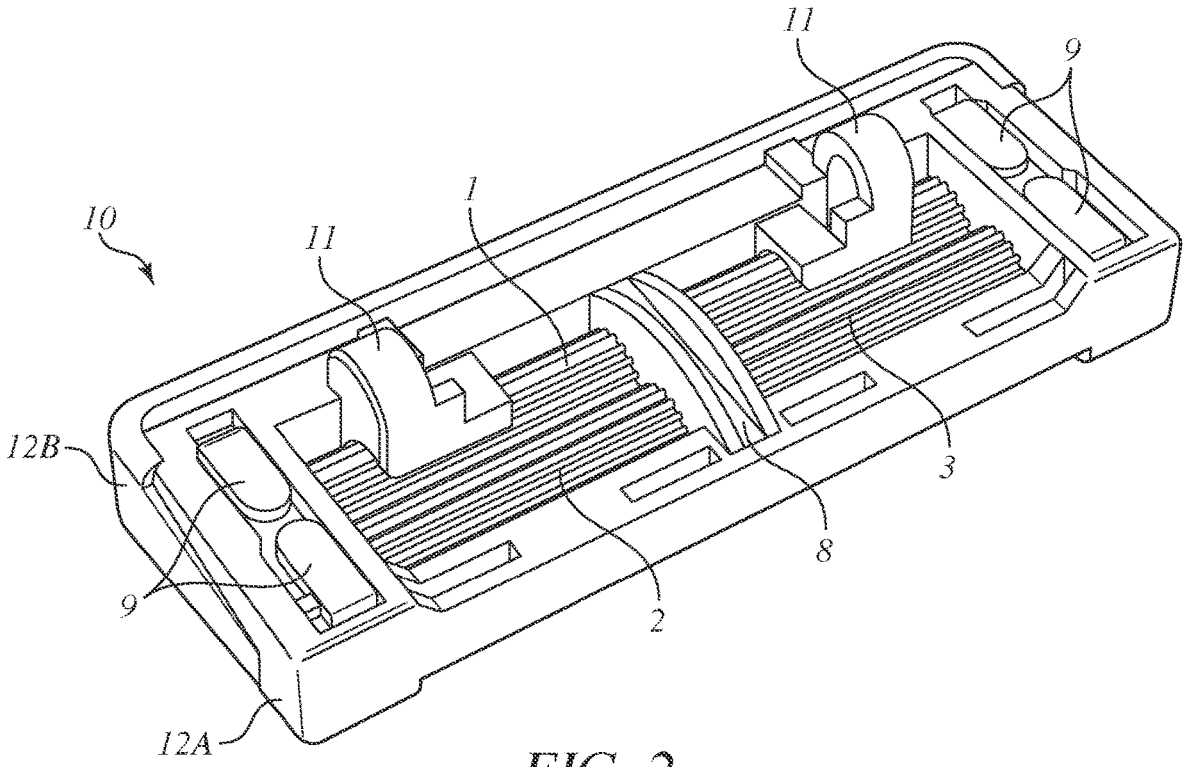
FIG. 2 is an isometric view of the top, rear and right side of the razor cartridge of FIG. 1.
Figure 3:
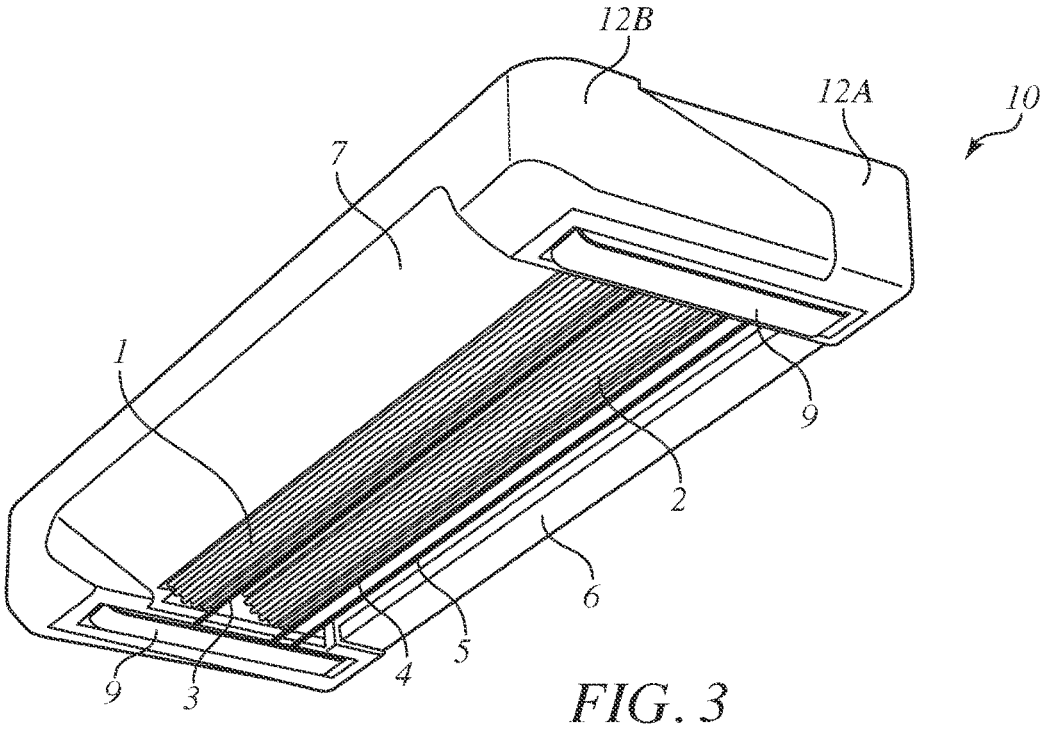
FIG. 3 is an isometric view of the top, front and left side of the razor cartridge of FIGS. 1 and 2.

The cutting blades 3, 4, 5 may be made entirely of steel, for instance, that of a conventional razor blade steel made from martensitic stainless steel with a composition of chromium between 12 and 14.5%, a carbon content of approximately 0.6%, and the remainder iron and trace elements. Alternatively, only the inclined portions 3B, 4B, 5B of the cutting blades 3, 4, 5 may be made of such a steel either partially or entirely and the base portions 3C, 4C, 5C of the cutting blades 3, 4, 5 may be made of a different material such as a hard plastic or different metal. In that sense, the conventional razor blade steel would be placed on that different material and secured to it. That different material would have the acute bend. FIG. 2 of US published patent application no. 20110146079, which is incorporated herein by reference, depicts a sharpened cutting blade supported on an acutely angled portion of a base component.

Instead of being made from the conventional razor blade steel, the cutting blades 3, 4, 5 may be made of any stainless steel and carbon steel or made of a Damascus steel with a carbon steel edge or made of a corrosion resistant carbide steel made using a tungsten-carbon compound.

While the foregoing description and drawings represent the preferred embodiments of the present invention, various changes and modifications may be made without departing from the scope of the present invention.

What is claim is:

1. An anti-clogging razor device, comprising:

a razor cartridge having an alternating arrangement of rollers and cutting blades, the cutting blades each having a respective bend that forms an acute angulation between a respective base portion and a respective inclined portion, the respective base portion of each of the cutting blades extending in respective parallel planes that are parallel with each other, the respective inclined portion of each of the cutting blades terminates at respective sharpened edges that are within confines of a common shaving plane whose orientation is perpendicular to each of the respective parallel planes, the cutting blades including a leading cutting blade and a trailing cutting blade, the rollers including a leading roller and a trailing roller, the respective base portion of the leading cutting blade being situated between the leading roller and the trailing roller;

a housing supporting the alternating arrangement of the rollers and the cutting blades;

wherein the leading roller and the respective sharpened edge of the leading cutting blade are arranged relative to each other so that a plane that is parallel to the respective parallel planes and passes through the respective sharpened edge of the leading cutting blade also passes through the leading roller, wherein the trailing roller and the respective sharpened edge of the trailing cutting blade are arranged relative to each other so that an additional plane that is parallel to the respective parallel planes and passes through the respective sharpened edge of the trailing cutting blade also passes through the trailing roller, wherein the leading roller and the trailing roller each has an associated axis and an exterior surface with lengthwise ridges that are circumferentially separated from each other by respective ones of intervening lengthwise grooves, the lengthwise ridges of the leading roller extending parallel to the associated axis of the leading roller, the lengthwise ridges of the trailing roller extending parallel to the associated axis of the trailing roller, wherein the leading and trailing rollers are arranged relative to neighboring ones of the cutting blades to define paths between, wherein rotation of the leading and trailing rollers helps prevent clogging of the paths of debris because the rotation moves the debris further away from the respective sharpened edges, whereby the debris is cut hair, cut skin, and shaving cream or lather.

2. The anti-clogging razor device of claim 1, wherein the respective bends, the respective base portions and the respective inclined portions each being made of a material that is of a same composition.

3. The anti-clogging razor device of claim 1, wherein the housing has an inclined surface that is closer to the leading roller than to the trailing roller, further comprising:

a moisturizing strip that is closer to the trailing roller than to the leading roller.

4. The anti-clogging razor device of claim 3, further comprising:

two staples each having two bent staple portions and having a central portion extending between the two bent staple portions and having two free ends each extending from respective ones of the two staple bent portions toward each other, the staples retaining the cutting blades and the rollers within confines of the housing.

5. The anti-clogging razor device of claim 4, wherein the two staples are spaced apart from each other by a separation distance, the inclined surface extending lengthwise by a distance that is at most equivalent to the separation distance.

6. The anti-clogging razor device of claim 1, further comprising:

a pivotal attachment that is secured to the housing and configured to pivotally attach to a handle.

7. The anti-clogging razor device of claim 6, wherein the pivotal attachment includes two projections spaced apart from each other and each having a respective recess facing opposite each other, a rod retained by both of the respective recesses in a manner that enable the rod to rotate relative to the respective recesses, and a connector situated between the rod and the handle and securing both to each other.

8. The anti-clogging razor device of claim 7, further comprising an alignment guide having two concave portions aligned with respective ones of the leading roller and the trailing roller, the support being between and equidistant from the two projections.

9. The anti-clogging razor device of claim 1, further comprising:

a final cutting blade having an additional base portion and an additional inclined portion that extend from an additional bend and are acutely angled with respect to each other to extend within respective ones of a first additional plane and a second additional plane that intersect with each other at the additional bend, the trailing cutting blade being between the final cutting blade and the trailing roller, the additional inclined portion terminating into an additional sharpened edge within the second additional plane.

10. The anti-clogging razor device of claim 9, wherein the final cutting blade and the trailing cutting blade are arranged relative to each other so that another plane that is parallel to the respective parallel planes and passes through the additional sharpened edge of the final cutting blade also passes through the trailing cutting blade.

11. The anti-clogging razor device of claim 1, wherein the leading roller and the trailing roller are each a paddle roller.

* * * * *